US007885556B2

(12) United States Patent
Fujimori et al.

(10) Patent No.: US 7,885,556 B2
(45) Date of Patent: Feb. 8, 2011

(54) IMAGE FORMING APPARATUS FOR CORRECTING A TONER DENSITY TARGET VALUE

(75) Inventors: Kohta Fujimori, Kanagawa (JP); Shin Hasegawa, Kanagawa (JP); Nobutaka Takeuchi, Kanagawa (JP); Hitoshi Ishibashi, Kanagawa (JP); Yushi Hirayama, Kanagawa (JP); Naoto Watanabe, Kanagawa (JP); Kayoko Tanaka, Tokyo (JP); Kazumi Kobayashi, Tokyo (JP); Takashi Enami, Kanagawa (JP); Osamu Ariizumi, Kanagawa (JP); Fukutoshi Uchida, Kanagawa (JP); Shinji Kobayashi, Kanagawa (JP); Shinji Kato, Kanagawa (JP); Ryohta Morimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1089 days.

(21) Appl. No.: 11/532,383

(22) Filed: Sep. 15, 2006

(65) Prior Publication Data

US 2007/0065164 A1 Mar. 22, 2007

(30) Foreign Application Priority Data

Sep. 16, 2005 (JP) ..... 2005-270085

(51) Int. Cl.
*G03G 15/08* (2006.01)

(52) U.S. Cl. ..... 399/27; 399/28; 399/29; 399/30; 399/49

(58) Field of Classification Search ..... 399/27–30, 399/49

See application file for complete search history.

(56) References Cited

U.S. PATENT DOCUMENTS

| | | | | |
|---|---|---|---|---|
| 5,266,997 | A * | 11/1993 | Nakane et al. | 399/49 |
| 5,682,572 | A * | 10/1997 | Murai et al. | 399/27 |
| 2004/0253012 | A1 | 12/2004 | Ishibashi | |
| 2008/0069580 | A1 | 3/2008 | Oshige et al. | |
| 2008/0124107 | A1 | 5/2008 | Takeuchi et al. | |
| 2008/0145078 | A1 | 6/2008 | Tomita et al. | |
| 2008/0273885 | A1 | 11/2008 | Koizumi et al. | |
| 2009/0116861 | A1 | 5/2009 | Oshige et al. | |

FOREIGN PATENT DOCUMENTS

| | | |
|---|---|---|
| JP | 2000-330345 | 11/2000 |
| JP | 2003-91224 | 3/2003 |
| JP | 2005-77543 | 3/2005 |

OTHER PUBLICATIONS

U.S. Appl. No. 12/094,198, filed May 19, 2008, Kato et al.

* cited by examiner

*Primary Examiner*—Ryan D Walsh
(74) *Attorney, Agent, or Firm*—Oblon, Spivak, McClelland, Maier & Neustadt, L.L.P.

(57) ABSTRACT

In an image forming apparatus a developing device develops an electrostatic latent image on an image carrier with a developer that contains toner to obtain a toner image, a toner-amount detecting unit detects amount of toner attached to the toner image, and a toner-density detecting unit detects a density of toner in the developer. Moreover, a process control unit corrects a toner-density target value indicative of a target value of density of toner in the developer based on the amount of toner detected by the toner-amount detecting unit and the density of toner detected by the toner-density detecting unit, and a determines execution timing of next process based on corrected toner-density target value.

12 Claims, 10 Drawing Sheets

IMAGE FORMING APPARATUS FOR CORRECTING A TONER DENSITY TARGET VALUE

CROSS-REFERENCE TO RELATED APPLICATIONS

The present document incorporates by reference the entire contents of Japanese priority document, 2005-270085 filed in Japan on Sep. 16, 2005.

BACKGROUND OF THE INVENTION

1. Field of the Invention

The present invention relates to image forming apparatuses that employs the technique of electrophotography.

2. Description of the Related Art

In electrophotography apparatuses, which are image forming apparatuses that employs the technique of electrophotography, the amount of electric charge on a developing solution changes with changes in temperature and humidity and deterioration of the developing solution with time. If the amount of electric charge on a developing solution changes, its a development value γ changes. A development value γ is a value representing the magnitude of development capability of a developing solution. When the development value γ of a developing solution changes, the capability of the toner (development potential), which is in the developing solution, to get attracted toward an image carrier also changes, thereby changing image density and color reproducibility. To get around this problem, current development value γ of a developing solution is measured and the image forming conditions are changed based on the current development value γ.

Also, in two-component developing devices, unless the toner density in the developing solution is appropriately controlled, an abnormal image with background smudges or image dropping due to carrier attachment occur. To get around this problem, based on information from a toner density sensor measuring a toner magnetic permeability in a developer and information about the printed image area, the toner density is controlled to have a predetermined value.

However, if the toner density is always constant, when the development value γ is significantly changed, control may not be made with the development potential. Here, a reason for uncontrollability with the development potential can be explained by the following problems. That is, for multilevel grayscale in laser exposure, for example, grayscale crush occurs if the development potential is too low. Conversely, if the development potential is too high, the capacity of the power supply has to be increased, thereby increasing cost. If development is performed in an intense electric field, adhesion force is increased to cause a transfer failure.

To address the problems, in a conventional apparatus, as exemplarily disclosed in Japanese Patent Laid-Open Publication No. 2003-91224, when the toner density is normally controlled but the development value γ is significantly off the target, the control target value of the toner density is changed. For example, when the toner density is controlled at 5 weight percent and the development value γ is smaller than the target value by 0.3 $mg/cm^2 \cdot kV$, the control target value of the toner density is changed to 7 weight percent. Since the required toner attachment amount can be obtained simultaneously when the development value γ is detected, such as when the toner refilling amount is reduced, the development potential is calculated and used for subsequent image formation.

Meanwhile, when the target value of the toner density is changed, for example, when the target value is changed from 5 weight percent to 7 weight percent as explained above, there are a case where toner is refilled or consumed in advance before image formation (printing) until the toner density becomes the target toner density, and another case where a refill control target value is changed during printing so that the toner density follows the target value with a predetermined time constant. In the former case, the toner density is adjusted as a lead-up to printing, and therefore apparatus downtime (long latency time) occurs. In the latter case, although no downtime occurs, the toner density is changed during printing, thereby changing the image density.

SUMMARY OF THE INVENTION

It is an object of the present invention to at least partially solve the problems in the conventional technology.

According to an aspect of the present invention, an image forming apparatus includes an image carrier that caries an electrostatic latent image; a developing device that develops the electrostatic latent image on the image carrier with a developer that contains toner to obtain a toner image; a toner-amount detecting unit that detects amount of toner attached to the toner image; a toner-density detecting unit that detects a density of toner in the developer; and a process control unit that corrects a toner-density target value indicative of a target value of density of toner in the developer based on the amount of toner detected by the toner-amount detecting unit and the density of toner detected by the toner-density detecting unit, and a determines execution timing of next process based on corrected toner-density target value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention are explained below based on the drawings.

Figure 1:
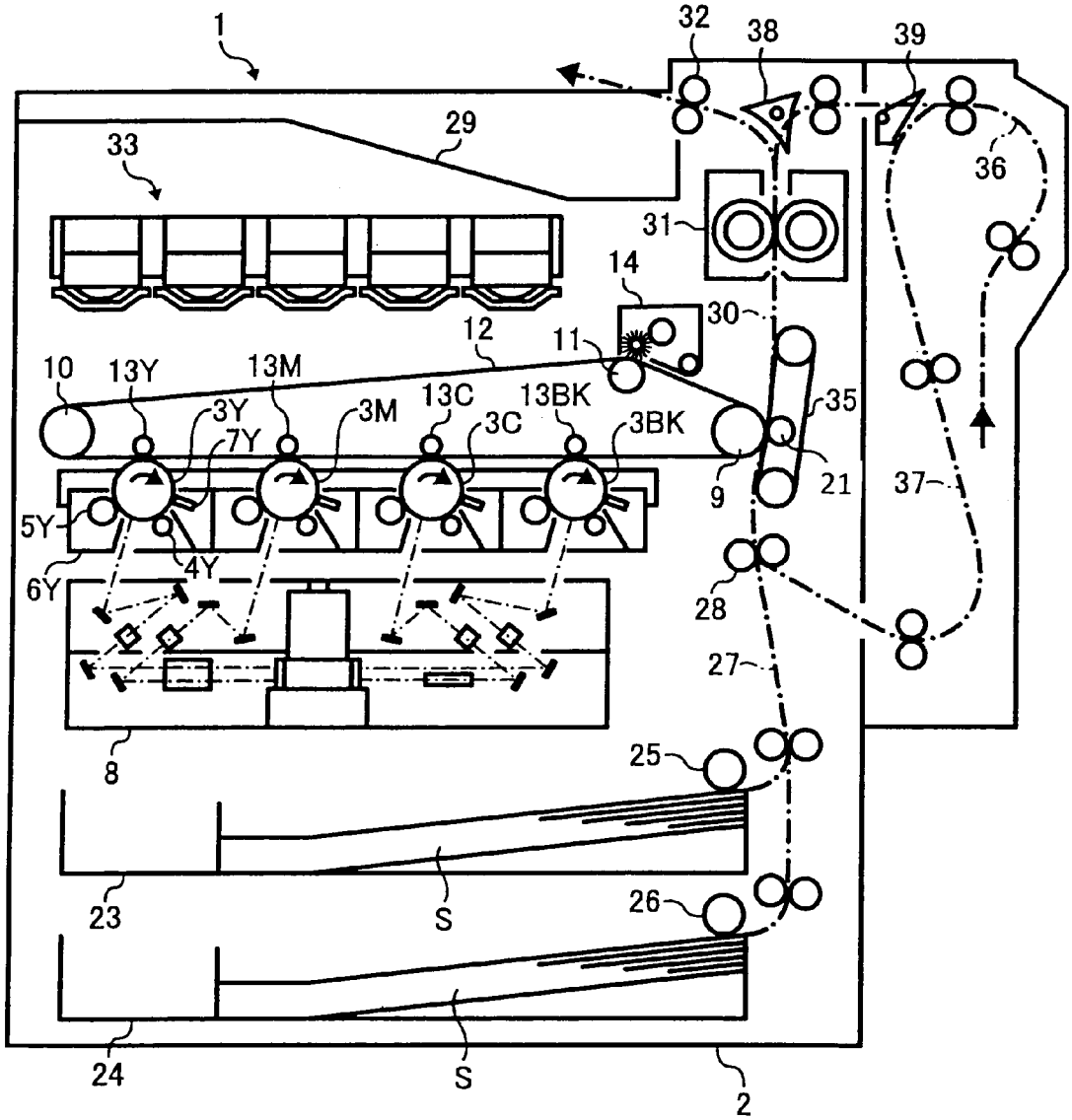
FIG. 1 is a side view of an internal structure of a full-color printer, which is an example of an image forming apparatus according to an embodiment of the present invention.

FIG. 1 is a side view of an internal structure of a full-color printer 1, which is an example of an image forming apparatus according to the present invention. The full-color printer 1 has an apparatus body 2 in which, four drum-like photosensitive members 3Y, 3M, 3C, and 3Bk are disposed in parallel at an approximately center portion of the apparatus body 2 so as to be equally separated from one another in a horizontal direction in the drawing in a horizontal state. Here, suffixes Y, M, C, and Bk represent yellow, magenta, cyan, and black, respectively, and these suffixes are omitted herein as required. The photosensitive member 3Y for yellow image has a structure in which an organic semiconductor layer made of a photoconductive material is provided on the surface of an aluminum cylinder having a diameter, for example, on the order of 30 millimeters to 100 millimeters, and is rotatably driven in a clockwise direction (a direction represented by an arrow in the drawing) in the drawing. Under and around the photosensitive member 3Y, image forming units are sequentially disposed according to an electrostatography process, including a charging roller 4Y, a developing device 6Y having a developing roller 5Y, and a cleaning unit 7Y. The same explanation applies to the photosensitive members 3M, 3C, and 3Bk for magenta, cyan, and black images. That is, only a difference is the toner color. Here, a belt-like photosensitive member can be used.

Under the photosensitive members 3Y, 3M, 3C, and 3Bk and the image forming units 4, 6, and 7, an exposing device 8 is provided for performing scanning irradiation of the uniformly-charged photosensitive members 3Y, 3M, 3C, and 3Bk with laser light corresponding to image data for each color to form an electrostatic latent image. Between each charging roller 4 and each developing roller 5 is a narrow space (slit) secured so that the laser light emitted from this exposing device 8 enters the photosensitive members 3Y, 3M, 3C, and 3Bk. The exposing device 8 in the depicted example is of a laser scan type using a laser light source, polygon mirror, and others, but an exposing device of a type in combination of an LED array and image forming means can be used.

Above the photosensitive members 3Y, 3M, 3C, and 3Bk is an intermediate transfer belt 12, which is a transfer unit supported by a plurality of rollers 9, 10, and 11 and rotatably driven in a counterclockwise direction. This intermediate transfer belt 12 is common to the photosensitive members 3Y, 3M, 3C, and 3Bk, and is placed so as to be flat and in a horizontal state to make contact with a portion after the developing a step of each of the photosensitive members 3Y, 3M, 3C, and 3Bk. In an inner rim of the belt, transfer rollers 13Y, 13M, 13C, and 13Bk are provided so as to face the photosensitive members 3Y, 3M, 3C, and 3Bk, respectively. In an outer rim of the intermediate transfer belt 12, a cleaning device 14 is provided at a position facing a roller 11. This cleaning device 14 removes unwanted toner remaining on the belt surface. Here, for example, the intermediate transfer belt 12 is a belt made of, as a base substance, a resin film having a thickness of 50 micrometers to 600 micrometers, or rubber, and has a resistance allowing toner images from the photosensitive members 3Y, 3M, 3C, and 3Bk to be transferred.

Also, in the apparatus body 2, paper feeding cassettes of a plurality of stages, two in this example, 23 and 24 are disposed below the exposing device 8 so as to be freely drawn. These paper feeding cassettes 23 and 24 each have a recording medium S, which is selectively fed by paper feeding rollers 25 and 26, respectively. Furthermore, a paper-supply conveying path 27 is formed so as to be approximately vertical toward a transfer position. Adjacent to the intermediate transfer belt 12 is a conveyer belt 35. In a loop of this conveyer belt 35, a transfer roller 21 is provided so as to face a roller 9, which is one of supporting rollers of the intermediate transfer belt 12. The roller 9 and the transfer roller 21 are pressed to each other via the intermediate transfer belt 12 and the conveyer belt 35, forming a predetermined transfer nip. Immediately before the transfer position on the paper-supply conveying path 27, paired resist rollers 28 for timing of paper feeding to the transfer position are provided. Furthermore, above the transfer position, a conveying and delivering path 30 is formed so as to be continued to the paper-supply conveying path 27 and lead to a delivered-paper stack unit 29 on an upper portion of the apparatus body 2. On this conveying and delivering path 30, a fixing device 31 having paired fixing rollers, paired paper delivering rollers 32, and others are disposed.

Here, in the apparatus body 2, a toner-container accommodating unit 33 is provided in a space below the delivered-paper stack unit 29. The toner-container accommodating unit 33 accommodates toner of the colors for use in the photosensitive members 3Y, 3M, 3C, and 3Bk and allows the toner to be conveyed and supplied by a pump, for example, to the corresponding developing device 6.

In such a structure, an operation of forming an image on the recording medium S is explained. First, with the actuation of the exposing device 8, the surface of the photosensitive member 3Y uniformly changed by the charging roller 4Y is irradiated with laser light corresponding to image data for yellow emitted from a semiconductor laser, thereby forming an electrostatic latent image. This electrostatic latent image is subjected to a developing process by the developing device 6Y to be developed with yellow toner, and then becomes a visible image. The image is then subjected to a transfer operation for transfer by the transfer roller 13Y on the intermediate transfer belt 12 moving in synchronization with the photosensitive member 3Y. Such latent-image formation, development, and transfer operations are sequentially and similarly performed at the photosensitive members 3M, 3C, and 3Bk sides in proper timing. As a result, a full-color toner image in which toner images of respective colors of yellow Y, magenta M, cyan C, and black Bk are sequentially overlaid is carried and conveyed on the intermediate transfer belt 12.

On the other hand, the recording medium S is fed from either one of the paper feeding cassettes 23 and 24, and is conveyed through the paper-supply conveying path 27 to the resist rollers 28. In proper timing with the full-color toner image on the intermediate transfer belt 12, the recording medium S is sent from the resist rollers 28. Then, with the operation of the transfer roller 21, the full-color toner image on the intermediate transfer belt 12 is transferred onto the recording medium S. The recording medium S with the full-color toner image transferred thereon is then conveyed by the conveyer belt 35 to the fixing device 31 and, after a fixing process by the fixing device 31, is delivered by the paper delivering rollers 32 to the delivered-paper stack unit 29.

In both-side printing, the recording medium S after fixing is guided to a reversing path 36 by switching a switching claw 38. Then, by switching a switching claw 39, the recording medium S after reversing is again fed from a paper re-feeding path 37 to the resist rollers 28 to turn the sheet over. At this time, a toner image as a back-surface image is previously formed and carried on the intermediate transfer belt 12, and then the toner image is transferred to the back surface (a second surface) of the recording medium S. Then, after a fixing process by the fixing device 31, the recording medium S is delivered by the paper delivering rollers 32 onto the delivered-paper stack unit 29.

Here, the case of full-color printing has been explained. However, even at the time of monochrome printing with a specific color or black, the operation is similar, except that some photosensitive members are not used.

Figure 2:
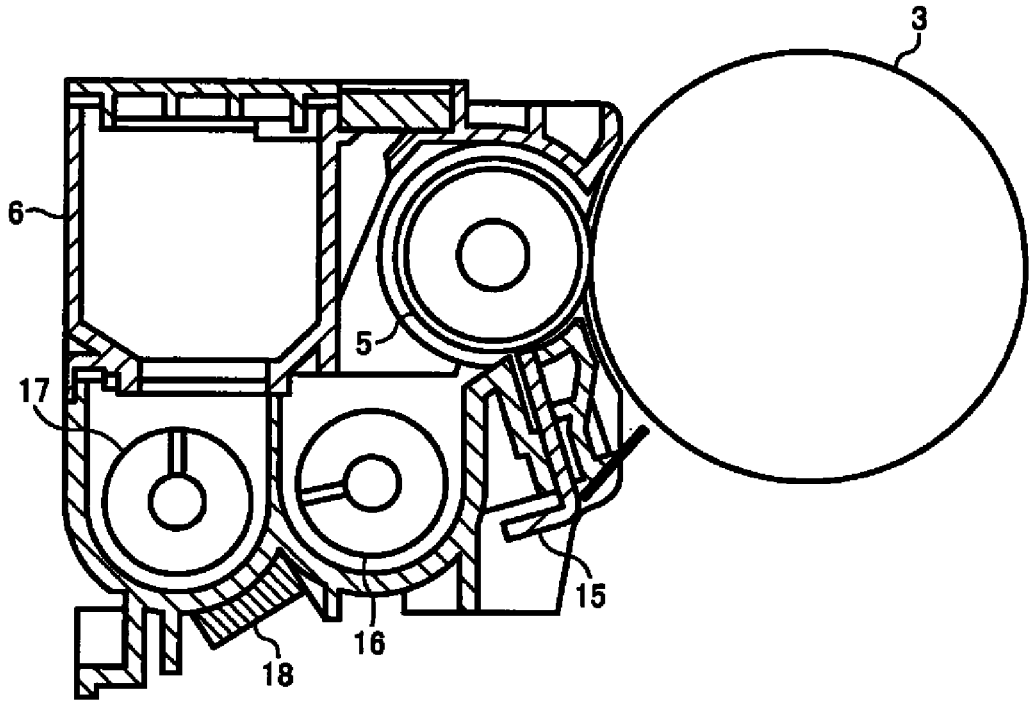
FIG. 2 is a detailed cross section of the internal structure of a developing device shown in FIG. 1.

FIG. 2 is a section view of the internal structure of the developing device 6. The developing device 6 includes the developing roller 5, which is a developing-solution carrier and is disposed so as to face the photosensitive drum 3. Under the developing roller 5 is a doctor blade 15, which is a developing-solution regulating member. Also, the developing device 6 includes a two-shaft conveyer screw including a first screw 16 and a second screw 17. A toner density sensor 18 is provided at a position under a developing-solution room on the second screw 17 side. As the toner density sensor 18, for example, a unit that measures a toner magnetic permeability in the developer is used.

Figure 3:
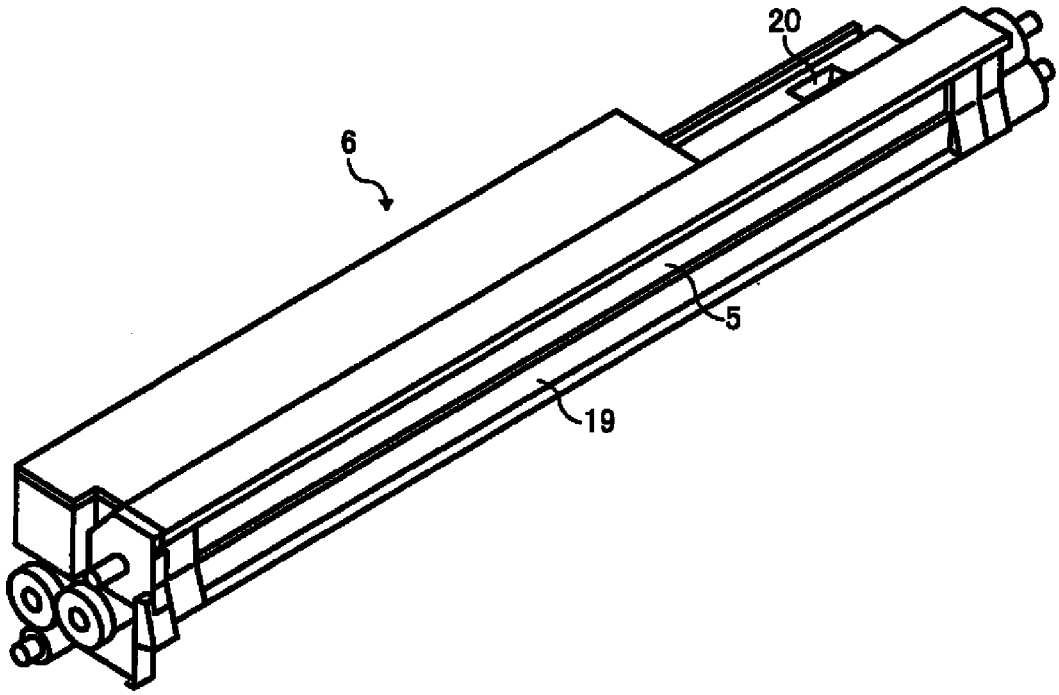
FIG. 3 is an external perspective view of the developing device shown in FIG. 1.

FIG. 3 is an external perspective view of the developing device 6. An entrance seal 19 is provided so as to cover the lower side of the developing roller 5. In the drawing, a lower-left side is the front side of the full-color printer 1, whilst a upper-right side is the back side thereof. A toner refilling port 20 is provided on the upper surface of the developing device 6 on the back side.

Figure 4:
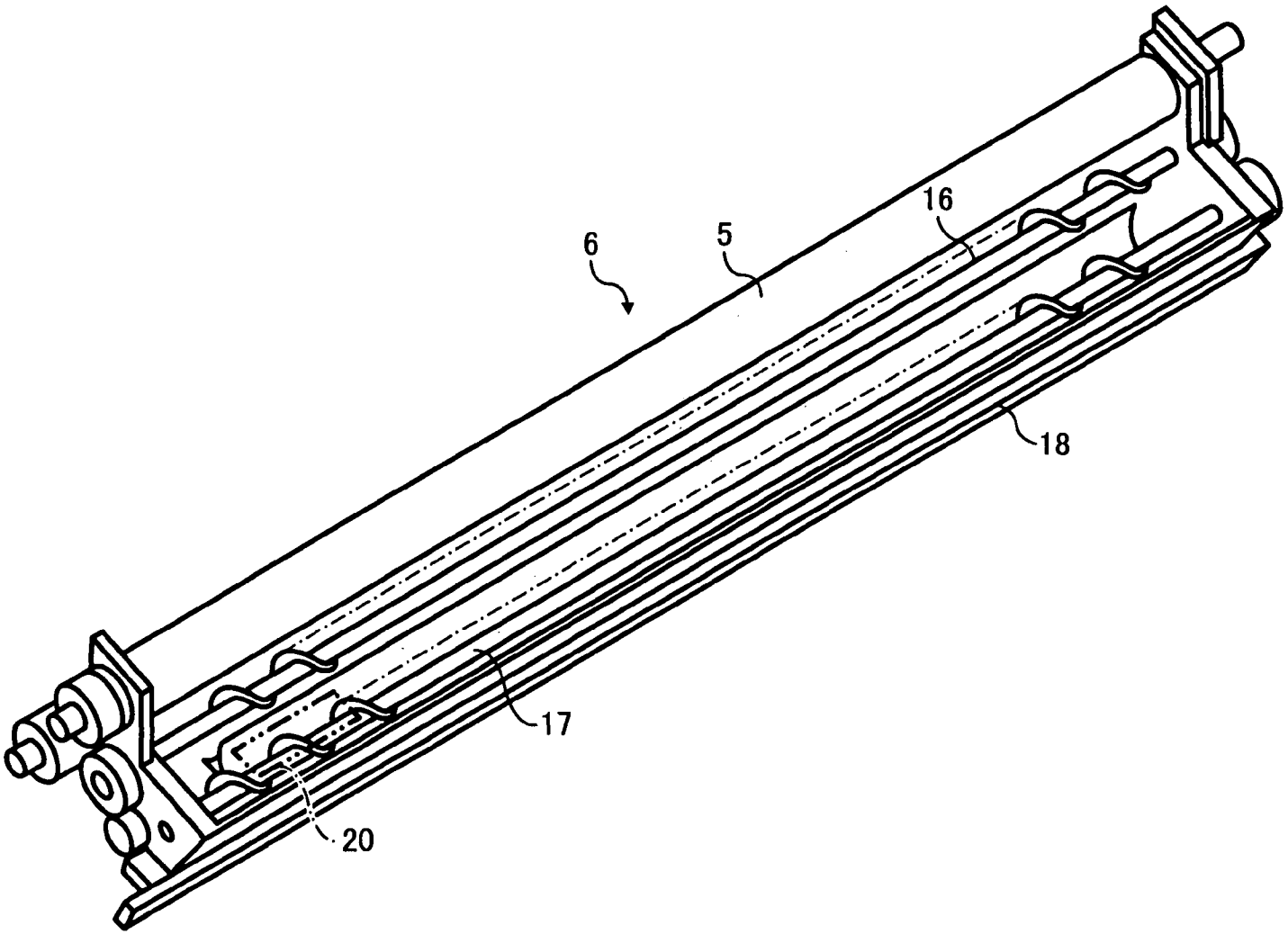
FIG. 4 is a perspective view of the inside of the developing device shown in FIG. 3.

FIG. 4 is a perspective view of the inside of the developing device 6. Inside the developing device 6, the developing solution is mixed and conveyed by the first screw 16 and the second screw 17, which are two-shaft conveyer screw, in a direction represented by arrows. Both ends of the developing-solution room in which the conveyer screws are disposed are communicated to each other. Therefore, the developing solution is circulated in the developing device. Here, in the drawing, a front-back relation of the device is reverse to that in FIG. 3, and the toner refilling port 20 (represented by a virtual line) is located on a lower-left side in the drawing.

Figure 5:
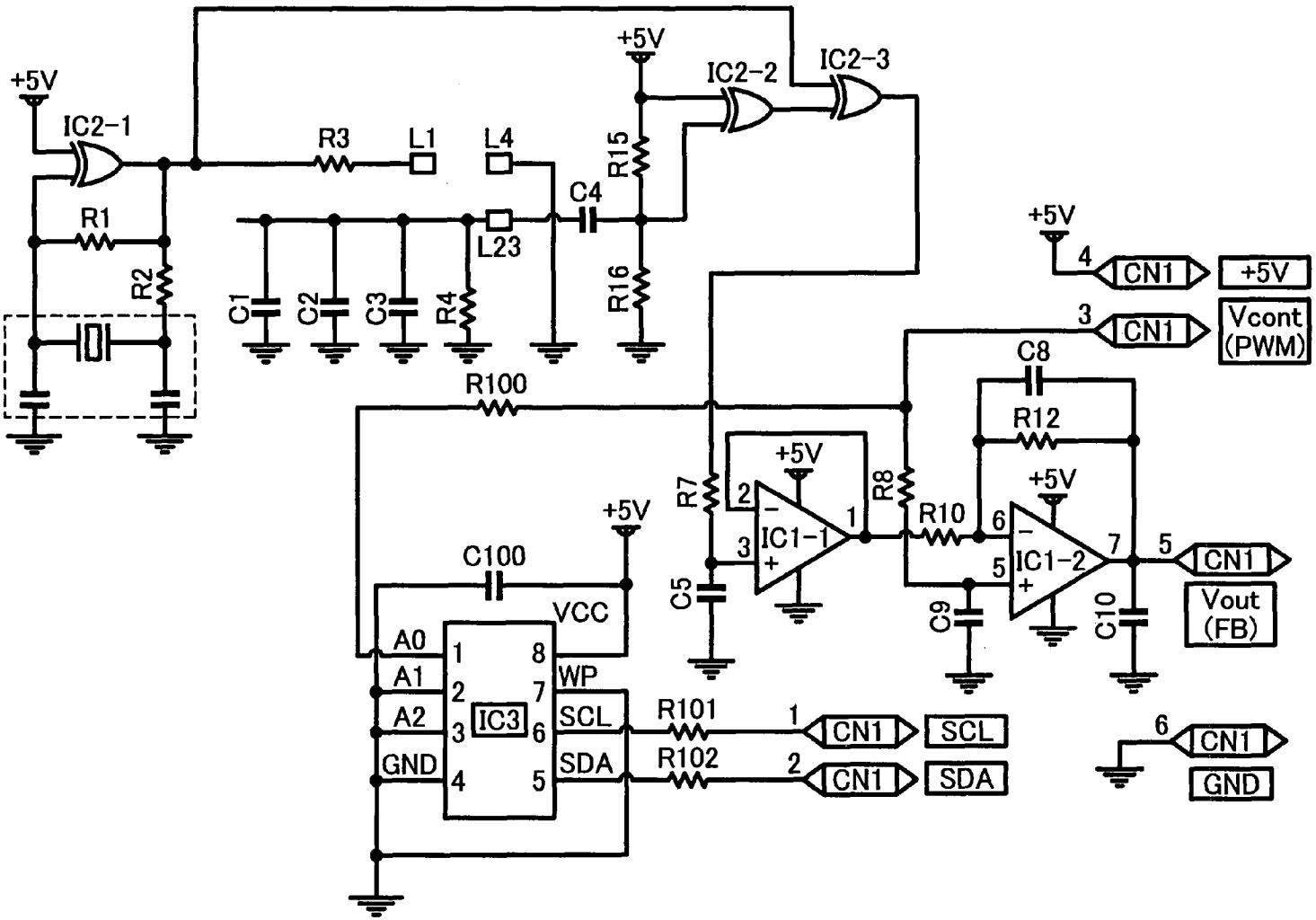
FIG. 5 is a circuit diagram of a toner-density sensor-sensitivity information storage device.
Figure 6:
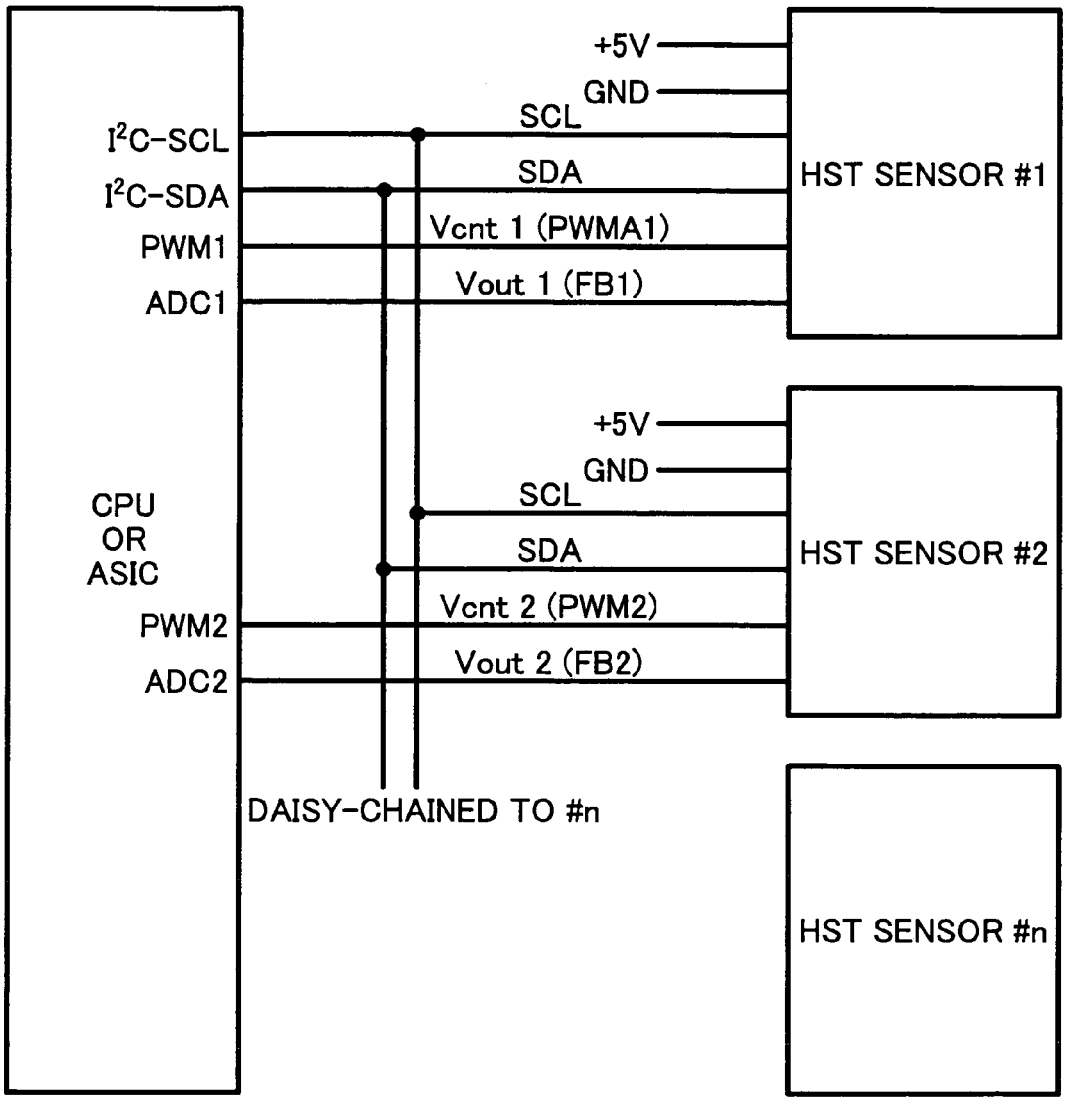
FIG. 6 is a functional block diagram of the toner-density sensor-sensitivity information storage device shown in FIG. 5.
Figure 7:
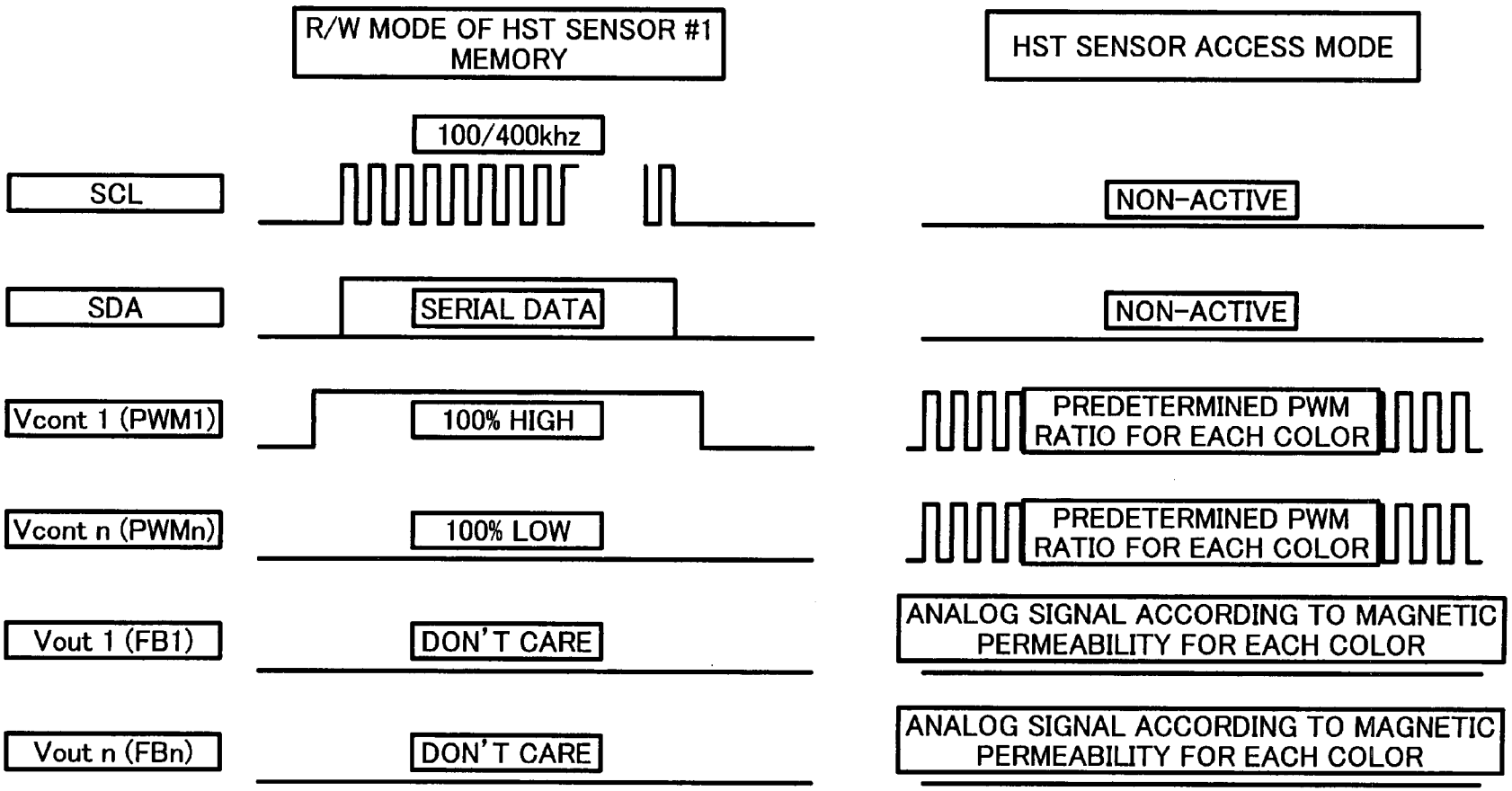
FIG. 7 is a timing chart of the operations of the toner-density sensor-sensitivity information storage device shown in FIG. 5.

The toner density sensor 18 for use in this example is of an integral type with a toner-density sensor-sensitivity information storage device and a toner density sensor being combined as one. A circuit diagram of the toner-density sensor-sensitivity information storage device is depicted in FIG. 5, whilst a block diagram of the toner-density sensor-sensitivity information storage device is depicted in FIG. 6. FIG. 7 is a timing chart of the toner-density sensor-sensitivity information storage device. Here, as a central processing unit (CPU) (or an application-specific integrated circuit (ASIC)) in the block diagram of FIG. 6, a control unit (CPU) of the full-color printer is used in this example.

Figure 8:
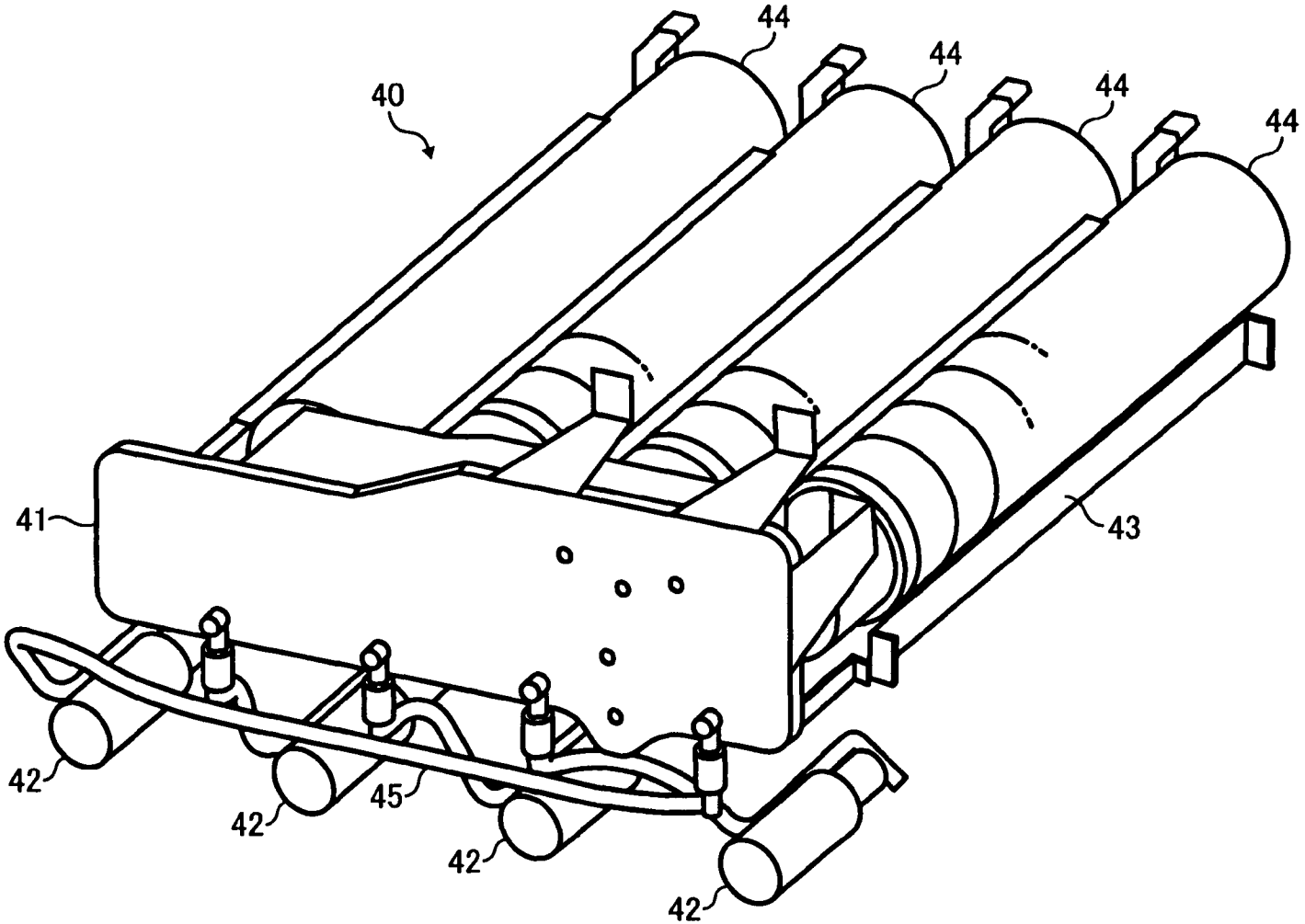
FIG. 8 is a perspective view of a toner refilling device.

FIG. 8 is a perspective view of a toner refilling device 40 that refills the developing device 6 with toner. The toner refilling device 40 includes a driving unit 41, powder pumps 42, toner cartridges 44 set on a base 43, and other components. Toner of each color is sent via a conveyer tube 45 to the developing device 6. For toner refilling, a toner refilling clutch in the driving unit 41 is turned on. Here, the case is explained in which four toner cartridges 44 accommodating for yellow, magenta, cyan, and black are provided. Alternatively, as shown in FIG. 1 as the toner-container accommodating unit 33, five cartridges may be provided with one cartridge for each of yellow, magenta, and cyan and two cartridges for black toner, which are heavily used.

Figure 9:
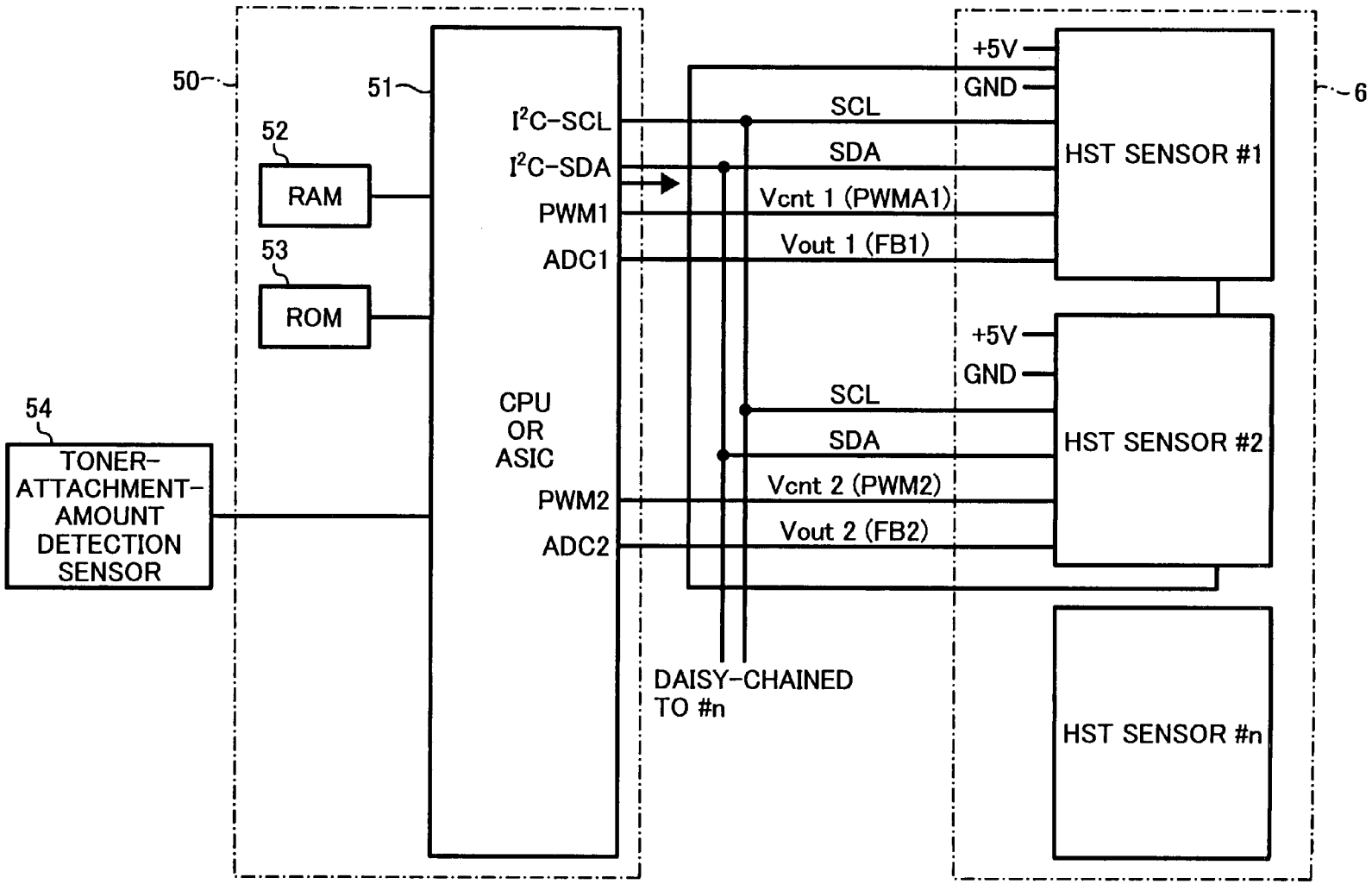
FIG. 9 is a functional block diagram of the toner refilling device shown in FIG. 8.

FIG. 9 is a block diagram depicting the structure of the toner refilling device 40. As depicted in the drawing, a CPU 51 included in a body control unit 50 of the full-color printer 1 has connected thereto a random-access memory (RAM) 52, a read-only memory (ROM) 53, and a toner-attachment-amount detection sensor 54, which will be explained further below. Also, the CPU 51 is connected to the toner-density sensor-sensitivity information storage device (FIG. 6) of each developing device 6.

Figure 10:
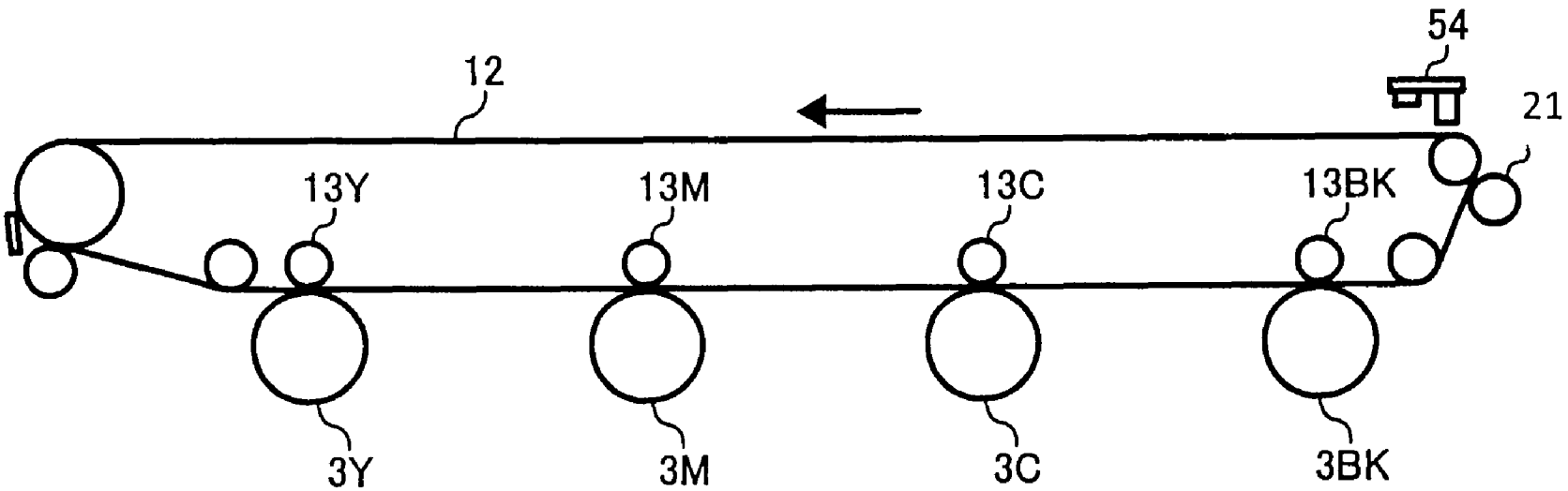
FIG. 10 is a schematic diagram depicting an example of placement of a toner-attachment-amount detection sensor.

FIG. 10 is a schematic diagram depicting an example of placement of the toner-attachment-amount detection sensor. Here, in this drawing, a tension shape and the like of the intermediate transfer belt 12 is different from that in FIG. 1. However, the placement of the toner-attachment-amount detection sensor in FIG. 10 is similar to that in the case of full-color printer 1 in the present example depicted in FIG. 1.

As depicted in FIG. 10, the toner-attachment-amount detection sensor 54 is disposed at a position near a downstream side (downstream side in a rotating direction of the belt 12 represented by an arrow in the drawing) of the transfer position where the intermediate transfer belt 12 faces the transfer roller 21. The toner-attachment-amount detection sensor 54 measures the amount of toner transferred from the photosensitive drum 3 for each color to the intermediate transfer belt 12. A measuring scheme generally uses characteristics in which an output from a reflection optical sensor is changed based on the toner attachment amount.

Now, the contents of the process control to be executed in the full-color printer in this example are explained.

(1) The apparatus is activated. By activating the apparatus at power-on, various motors and various biases are turned on, thereby preparing for execution of the process control.

(2) The toner-attachment-amount detection sensor 54 is calibrated as required. In the present example, the amount of light emission of a light-emitting diode (LED) is adjusted so that a regular-reflection light-receiving output from an optical sensor is 4 volts. However, calibration of the sensor is not essential to the present invention.

(3) An output (VT0) of the toner density sensor 18 in the developing device 6 is obtained. This measurement is performed to know the current toner density, and is required for correction of the toner density (VTREF).

(4) A gray-tone pattern is generated. This is required to detect the development value γ. Specifically, in this example, to correspond to a position where the toner-attachment-amount detection sensor 54 is provided (a position in an axial direction of the roller around which the intermediate transfer belt 12 is wound), ten gray-tone patterns are generated with a width in a main scanning direction of 15 millimeters, a width in a sub-scanning direction of 16 millimeters, and a pattern interval of 50 millimeters. At the time of writing the formed patterns, it is assumed that the amount of exposure is in full exposure (a value at which the photosensitive drum 3 is sufficiently diselectrified), and a development bias (Vβ) and a charge bias (Vc) are changed for each pattern, thereby generating gray-tone patterns.

(5) The gray-tone patterns are detected by the toner-attachment-amount detection sensor 54. The toner attachment amount of each of the gray-tone patterns generated and transferred onto the intermediate transfer belt 12 is measured by the toner-attachment-amount detection sensor 54. In this example, as explained above, a reflection optical sensor is used.

(6) The development value γ and a development start voltage are found. The development value γ and the development start voltage are found from a relation between the development bias (Vβ) and the toner attachment amount. Specifically, with the development bias being on the horizontal axis and the toner attachment amount being on the vertical axis, the method of least squares is used to find a linear equation. The gradient of this linear equation is referred to as the development value γ, whilst the X intercept is referred to as the development start voltage.

(7) A required development bias is found to obtain a target toner attachment amount. Based on the linear equation, the development bias (horizontal axis) is found from the target toner attachment amount (vertical axis). A value of the target toner attachment amount required to obtain a top density (dark portion) is predetermined (in general, 0.4 mg/cm$^2$ to 0.6 mg/cm$^2$, although depending on the degree of coloring of the toner pigments).

The development bias found here is taken as the development bias (Vβ) of an image portion. The charge bias (Vc) is predetermined so as not to allow a carrier to be flown to the photosensitive member (in general, Vβ=400 volts to 700 volts, and Vc=Vβ+100 volts). Vβ and Vc found in the manner are stored in the RAM 52 of the body control unit.

(8) A toner-density target value (VTREF) is corrected. From the development value γ and a toner-density sensor output (VT0), the toner-density target value (VTREF) is corrected.

That is, Δγ=development value γ detection value−development value γ target value is calculated. Here, the development value γ target value is determined in advance for each apparatus and it is, for example, 1.0 mg/cm$^2$/kV. This means that, with a development potential of 1000 volts (1 kilovolt), toner of 1.0 mg/cm$^2$ is attached to the photosensitive member. When the development start voltage=0 volt and the target toner attachment amount is 0.5 mg/cm$^2$, a development potential (Vp) of 500 volts is required. Since Vp=Vβ−V1, when V1=100 volts, Vβ is 600 volts. V1 represents a potential after exposure, and because of a potential of the photosensitive member after sufficient exposure, this depends on photosensitive-member characteristics. When Δγ exceeds a predetermined value, Vβ exceeds a settable range or an abnormal image occurs. Thus, the target value (VTREF) of the toner density is corrected so that Δγ is within a target range. However, if VT0 and VTREF greatly differ from each other at this time, no correction is made.

An example of correction is as follows.

The first correction condition: when Δγ≧0.30 mg/cm$^2$/kV (high) and VT0−VTREF≧−0.2 volts, VTREF=VT0−0.2 volts. That is, the target value is set so as to decrease the toner density from the present time.

The second correction condition: when Δγ≦0.30 mg/cm$^2$/kV (low) and VT0−VTREF≦0.2 volts, VTREF=VT0+0.2 volts. That is, the target value is set so as to increase the toner density from the present time.

Other than the first correction condition and the second correction condition, it is assumed that VTREF=previous value.

(9) The next process control execution time is determined. Based on Δγ calculated in the manner, the next process control execution time is determined. If Δγ is large, the toner-density target value (VTREF) is change in the process (8), and therefore the toner density is gradually changed through toner refill control at the time of subsequent printing. Therefore, fluctuations in image density occurs. For this reason, the next process control is executed with a smaller number of sheets printed than normal.

An example is as follows.

The first execution condition: when Δγ≧0.30, the next process control execution time is after 30 sheets have been printed.

The second execution condition: when −0.3<Δγ<0.3, the next process control execution time is after 200 sheets have been printed.

The third execution condition: when Δγ≦−0.3, the next process control execution time is after 30 sheets have been printed.

Meanwhile, when the next process control execution time is determined in the manner, if Δγ is equal to or larger (or smaller) than 0.3 for every process control, a process control is executed for each 30 sheets printed. With such frequent process control, apparatus downtime is increased. To get around this problem, how many times such a state (Δγ is equal to or larger or smaller than 0.3) continues may be detected for determining the execution of the process control.

An example in such a case is as follows. When it is assumed that the number of successive times of the state of Δγ being equal to or larger or smaller than 0.3 is N, The fourth execution condition: when Δγ≧0.3 and N≦3, the next process control execution time is after 30 sheets have been printed. Also, N=N+1.

The fifth execution condition: when Δγ≦−0.3, the next process control execution time is after 30 sheets have been printed. Also, N=N+1.

The sixth execution condition: Other than the fourth and the fifth conditions, the next process control execution time is after 200 sheets have been printed. Also, N=0.

By controlling the execution of the next process control with such execution conditions, the number of times of shortening the execution interval is limited. Therefore, even if a development value γ is not controlled as intended, such as when the toner refilling amount is reduced, the interval of executing the process control is not shortened without limitation.

Also, for example, an operation panel may be provided to set the process control execution time.

By way of example, a selection screen for allowing a process control execution time to be selected is displayed on an operation panel of the full-color printer 1. On this selection screen, as the process control execution time (execution condition), a fixed number of sheets or a variable number of sheets can be selected. Here, if the variable number of sheets is selected, the first to the third conditions or the fourth to the sixth conditions are used. if the fixed number of sheets is selected, the next process control execution time is after 200 sheets have been printed.

In this manner, with the process control execution time being provided to be settable (selectable), a control of shorting the interval of executing the process control can be turned off. With this, a user can select image quality or productivity to prioritize. According to the selection, the process control execution interval (the next process control execution time) can be determined. Therefore, appropriate printing according to a user's desire can be performed.

Here, at the time of power-on of the apparatus body, how the state of the developing solution has been changed since power-off cannot be known. Therefore, a special execution condition is preferably determined.

By way of example, the process control is executed if a predetermined condition is satisfied at the time of power-on of the apparatus body. A first predetermined condition is that more than six hours have elapsed after the previous printing ends. A second predetermined condition is that an amount of change in relative humidity after printing ends is equal to or larger than 30% relative humidity. These thresholds are set to a level at which a change in image density due to a change in charged amount of the developing solution cannot be tolerated.

Next, a toner refilling control in the full-color printer 1 according to the present embodiment is explained. However, the toner refilling control itself is similar to that conventionally known.

(1) Printing of a first sheet is started.

(2) An output (VTn) from the toner density sensor 18 is obtained.

(3) From the number of pixels and resolution, an image area is calculated.

(4) From the image area and a difference between VTn and VTREF, a toner attachment amount for refilling at the time of printing a second sheet is calculated.

By way of example, toner refill amount at the time of next printing (milligram)= a first proportional factor×(VTn−VTREF)+a second proportional factor×image area×(1+a third proportional factor×(VTn−VTREF)

where the first, the second, and the third proportional factors are constants, the first proportional factor=50, VTn=3.20 volts, VTREF=3.00 volts, the second proportional factor=0.5, image area=31 square centimeters, and the third proportional factor=0.5, the toner refill amount at the time of next printing=10+0.5×31×(1+0.5×0.2)=27.05 milligrams.

(5) After the next printing is started, a toner refilling clutch is turned on for a predetermined time. The on-time is determined by the toner refilling amount calculated in (4) and refilling capability of the refilling system (in this example, the toner refilling device 40 in FIG. 8).

Effects of the present invention are explained in comparison with the conventional technology.

Figure 11:
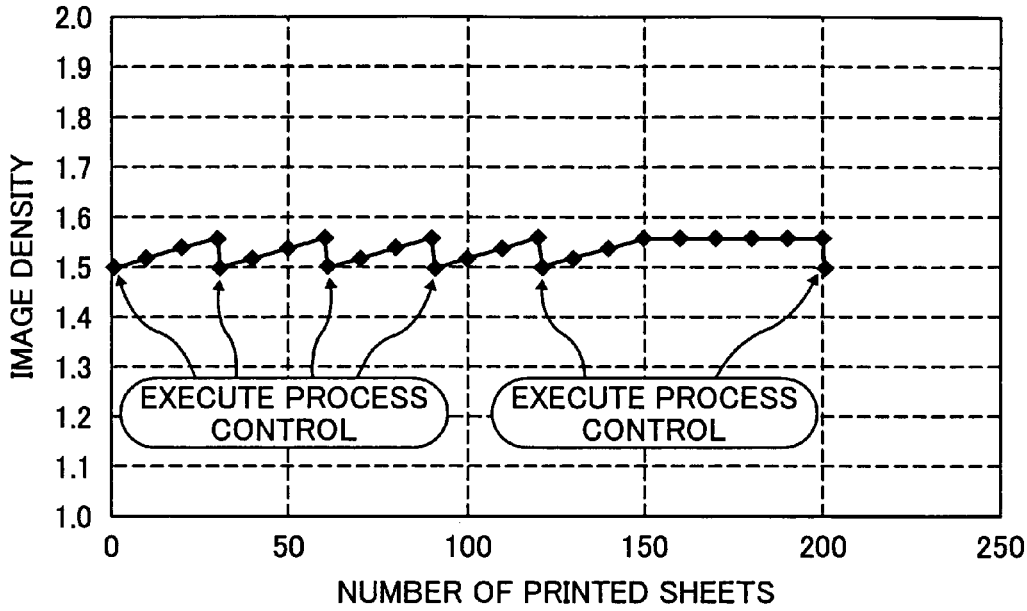
FIG. 11 is a graph depicting transitions of image density according to the number of sheets printed in an embodiment of the present invention.
Figure 12:
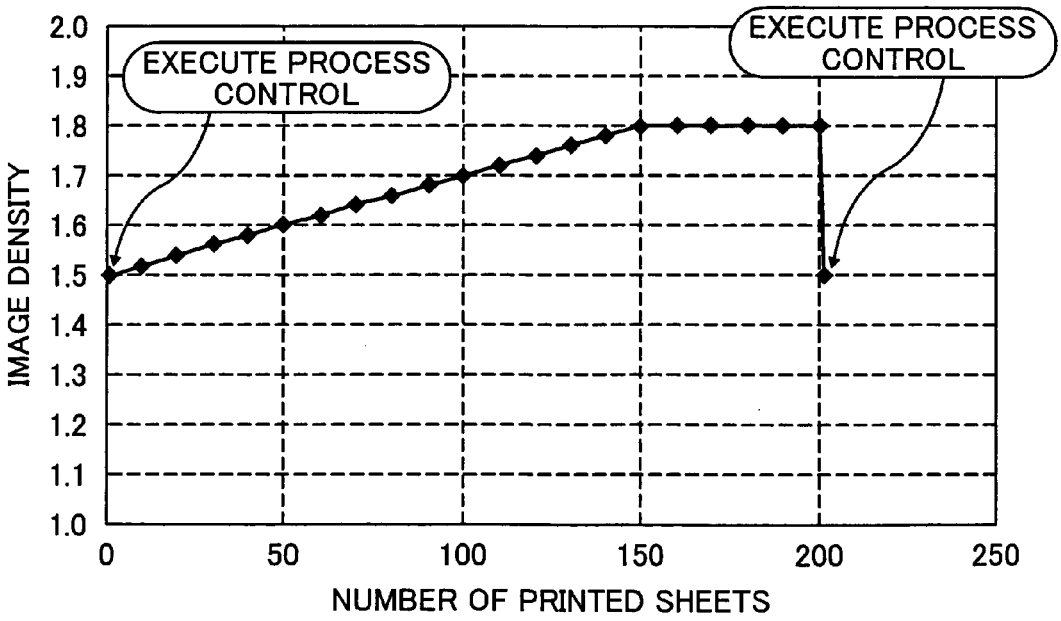
FIG. 12 is a graph depicting transitions of image density according to the number of sheets printed in an example of a conventional apparatus.

FIG. 11 is a graph depicting transitions of image density according to the number of sheets printed in an embodiment of the present invention. FIG. 12 is a graph depicting transitions of image density according to the number of sheets printed in an example of a conventional apparatus. In both graphs, the vertical axis represents image density, whilst the horizontal axis represents the number of sheets printed.

In the conventional apparatus depicted in FIG. 12, a process control is executed before printing to control the image density to 1.5. However, by performing printing, the image density is changed. Then, a process control is executed after printing of 200 sheets to control the image density to 1.5. However, until then, the amount of fluctuations in image density is 0.3.

By contrast, in the case of the present embodiment depicted in FIG. 11, a process control is executed while the toner density is being changed (through a toner refilling control by correcting the toner-density target value). Therefore, every time the process control is executed, the toner density is appropriately kept. In the present embodiment, the amount of fluctuations in image density is 0.06, which is extremely small. Therefore, apparatus downtime can be prevented, and an excellent image can be obtained by suppressing a change in image density as much as possible.

An embodiment of the present invention has been explained with the example depicted in the drawings, but is not meant to be restrictive.

For example, the developing device can adopt an arbitrary structure as appropriate. Also, the toner density sensor and the toner refilling device can adopt an arbitrary structure as appropriate. The structure and placement of the toner-attachment-amount detection sensor can be changed as appropriate. As for the toner attachment amount, the toner attachment amount on the image carrier (photosensitive member) may be directly detected. The structure of the image forming unit of the image forming apparatus and the exposing device can be arbitrary. Also, the present invention is not restrictively applied to a full-color device, but can be applied to a monochrome device or a plural-color device. The image forming apparatus is not restricted to a printer, but may be a copier, a facsimile machine, and, furthermore, a multifunction product with a plurality of functions.

According to the image forming apparatus of one aspect of the present invention, a process control is executed while the toner density is being changed. In every process control, the toner density is appropriately kept. Therefore, apparatus downtime can be prevented, and an excellent image can be obtained by suppressing a change in image density as much as possible.

According to another aspect, the number of times of shortening an interval of executing a process control is limited. Therefore, even if a development value γ is not controlled as intended, the interval of executing the process control is not shortened without limitation.

According to still another aspect, whether to determine the next process control execution time based on the correction results is selectively provided. Therefore, a control of shorting the interval of executing the process control can be turned off. With this, a user can select image quality or productivity to prioritize, and appropriate printing according to a desire of the user can be performed.

According to still another aspect of the present invention, the process control can be executed at an appropriate time.

According to still another aspect of the present invention, the process control is executed when a predetermined condition is satisfied at power-on of an apparatus body. This can address the case where the state of the developing solution is unknown.

According to still another aspect of the present invention, the predetermined condition includes a condition in which hours not shorter than six hours have elapsed after printing ends. Therefore, even if a printing interval is large, an appropriate image density can be obtained.

According to still another aspect of the present invention, the predetermined condition includes a condition in which an amount of change in relative humidity after printing ends is equal to or larger than 30% relative humidity. Therefore, even if a change in humidity is large, an appropriate image density can be obtained.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier that carries an electrostatic latent image;

a transfer belt facing the image carrier;

a developing device that develops the electrostatic latent image on the image carrier with a developer that contains toner to obtain a toner image;

a toner-amount detecting unit that detects an amount of toner of the toner image, the toner-amount detecting unit disposed at a position proximate to the transfer belt at a downstream side of the image carrier;

a toner-density detecting unit that detects a density of toner in the developer, the toner-density detecting unit disposed adjacent to the developing device; and a process control unit configured to perform a process of determining a corrected toner-density target value, indicative of a target value of density of toner in the developer, based on the amount of toner detected by the toner-amount detecting unit and the density of toner detected by the toner-density detecting unit, and determines an execution timing of the toner-density target value correction process based on a development value, wherein the development value is derived, in part, based on the amount of toner detected by the toner-amount detecting unit.

2. The image forming apparatus according to claim 1, wherein the process control unit determines the execution timing of a subsequent toner-density target value correction process based on correction results of the toner-density target value for a plurality of times of correction.

3. The image forming apparatus according to claim 1, further comprising a setting unit that sets whether the process control unit is to determine the execution timing.

4. The image forming apparatus according to claim 1, wherein the corrected toner-density target value is a difference between the toner-density target value and a detection value, and an interval of executing the toner-density target value correction process can be changed based on the difference.

5. The image forming apparatus according to claim 1, wherein the process control unit executes the toner-density target value correction process when a predetermined condition is satisfied at a power-on of the image forming apparatus.

6. The image forming apparatus according to claim 5, wherein the predetermined condition is that about six hours or more than six hours have elapsed after printing ends.

7. The image forming apparatus according to claim 5, wherein the predetermined condition is that an amount of change in relative humidity after printing ends is equal to or larger than 30% relative humidity.

8. The image forming apparatus according to claim 1, wherein the toner-amount detecting unit detects the amount of toner of the toner image which has been transferred from the image carrier to the transfer belt.

9. The image forming apparatus according to claim 1 wherein the toner-amount detecting unit detects the amount of the toner of the toner image which is on the image carrier.

10. The image forming apparatus according to claim 1, wherein the process control unit performs an analysis during the toner-density target value correction process to determine a difference between a predetermined development value and the development value derived by the amount of toner detected by the toner-amount detecting unit at a power-on of the image forming apparatus.

11. The image forming apparatus according to claim 10, wherein the process control unit determines the execution timing for a subsequent toner-density target value correction process based on the analysis of the difference in development values.

12. The image forming apparatus according to claim 1, wherein the process control unit is configured to derive the development value based, in part, on varying bias voltages corresponding to a test pattern applied during the toner-density target value correction process.

* * * * *